US008584568B1

(12) United States Patent
McMahon et al.

(10) Patent No.: US 8,584,568 B1
(45) Date of Patent: Nov. 19, 2013

(54) BOMB RACK LOCK

(75) Inventors: Roy P. McMahon, Indianapolis, IN (US); Michael R. Hlavek, Indianapolis, IN (US); Andrew L. Nelson, Indianapolis, IN (US)

(73) Assignee: Raytheon Company, Walthem, MA (US)

( * ) Notice: Subject to any disclaimer, the term of this patent is extended or adjusted under 35 U.S.C. 154(b) by 0 days.

(21) Appl. No.: 13/532,543

(22) Filed: Jun. 25, 2012

(51) Int. Cl.
*F41F 3/00* (2006.01)

(52) U.S. Cl.
USPC ..... 89/1.51

(58) Field of Classification Search
USPC ..... 89/1.51–1.59; 244/137.4
See application file for complete search history.

(56) References Cited

U.S. PATENT DOCUMENTS 2,776,570 A * 1/1957 Nelson et al. ..... 74/2
3,752,034 A * 8/1973 Waters ..... 89/1.58
3,877,343 A * 4/1975 Newell et al. ..... 89/1.51
4,120,232 A * 10/1978 Hoffman, Jr. ..... 89/1.51
4,441,674 A * 4/1984 Holtrop ..... 244/137.4
6,948,685 B2 * 9/2005 Hawthorne ..... 244/129.1
2007/0272800 A1 * 11/2007 Edelstein et al. ..... 244/137.4

* cited by examiner

*Primary Examiner* — Michael Carone
*Assistant Examiner* — Reginald Tillman, Jr.
(74) *Attorney, Agent, or Firm* — Thorpe North & Western LLP

(57) ABSTRACT

A bomb rack lock, as part of a bomb rack, comprising a plunger movable to engage a bomb rack linkage to be alternately secured and released and a solenoid body coupled to and operable to support the plunger. The plunger and the solenoid body are movable relative to each other and the bomb rack linkage and the solenoid body is movable between a first position and a second position. The bomb rack lock also includes a sensor to determine whether the solenoid body is in the first position. The plunger is movable to engage and disengage the bomb rack linkage with the solenoid body in the first position. In the second position, the solenoid body prevents engagement between the plunger and the bomb rack linkage.

10 Claims, 7 Drawing Sheets

BOMB RACK LOCK

BACKGROUND

Aircraft bomb racks have long had safety locks to prevent unintentional discharge of bombs from the racks. Current bomb rack safety locks can provide for remote locking and unlocking while the aircraft is in flight. However, due to the function bomb rack safety locks perform, safety and reliability considerations have caused current designs to be rather heavy, complicated and costly to implement. Additionally, some bomb rack safety locks are associated with pneumatically actuated bomb racks, which introduces additional challenges in bomb rack safety lock design and usage. Moreover, small bomb racks are typically not designed to use bomb rack locks and devices designed for larger bomb racks, thus leading to multiple designs on which in flight operators and ground crew must be trained.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1A:
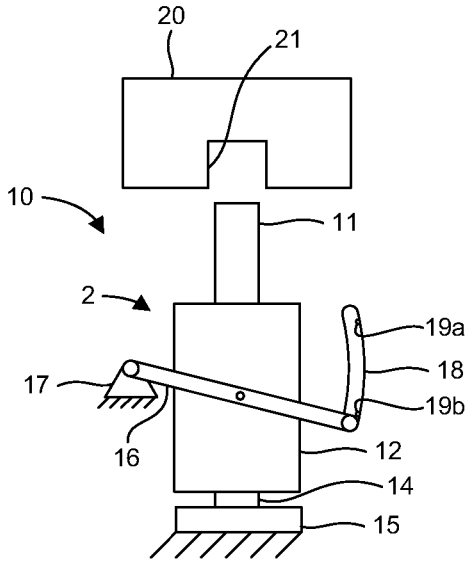
FIG. 1A is an example illustration of a bomb rack lock in a ground configuration, in accordance with an exemplary embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although the current bomb rack lock designs are indeed functional, they can be overly complex, large, and expensive, usually requiring a multitude of sensors and electronics. Additionally, current bomb rack lock designs are also typically single task devices that only lock/unlock a bomb rack.

A bomb rack lock as part of and for a bomb rack is disclosed that is easy to use, scalable to a small size, and combines operational functions into single components. In one aspect, the bomb rack lock can include features that eliminate common operator error associated with loading bombs, thus improving operational safety. The bomb rack lock can include a plunger movable to engage a bomb rack linkage of the bomb rack to be alternately secured and released and a solenoid body coupled to and operable to support the plunger. The plunger and the solenoid body can be movable relative to each other and the bomb rack linkage, and the solenoid body can be movable between a first position and a second position. The bomb rack lock can also include a sensor to determine whether the solenoid body is in the first position. The plunger can be movable to engage and disengage the bomb rack linkage with the solenoid body in the first position. In the second position, the solenoid body can prevent engagement between the plunger and the bomb rack linkage.

A bomb rack lock system is further disclosed. The bomb rack lock system can include a bomb rack linkage selectively movable between at least first and second positions. The system can also include a piston in fluid communication with a fluid source via a fluid conduit, the fluid source being configured to provide a pressurized fluid to actuate the piston to apply a force to the bomb rack linkage to cause the bomb rack linkage to move. Furthermore, the system can include a bomb rack lock operable with the bomb rack linkage to alternately secure and release the bomb rack linkage. The bomb rack lock can include a solenoid body and a plunger coupled to the solenoid body, the plunger being movable relative to the solenoid body to engage and disengage the bomb rack linkage. Additionally, the system can include a redundancy system to prevent unwanted movement of the bomb rack linkage. The redundancy system can include a vent in fluid communication with the fluid source and having an open position and a closed position. The redundancy system can also include a coupling between the plunger and the vent, the coupling being configured to activate and open the vent when the plunger is engaged with the bomb rack linkage, and to deactivate and close the vent when the plunger is disengaged from the bomb rack linkage. When open, the vent can cause the pressurized fluid to escape the fluid conduit to prevent actuation of the piston and movement of the bomb rack linkage. When closed, the vent can prevent pressurized fluid from escaping the fluid conduit via the vent to facilitate movement of the bomb rack linkage.

Figure 1B:
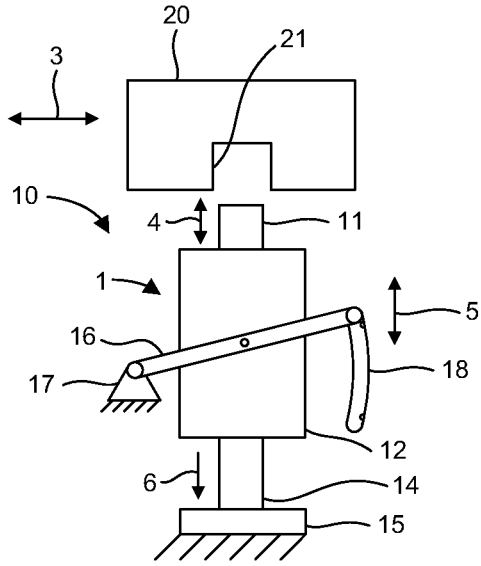
FIG. 1B is the bomb rack lock of FIG. 1A in an armed configuration.
Figure 1C:
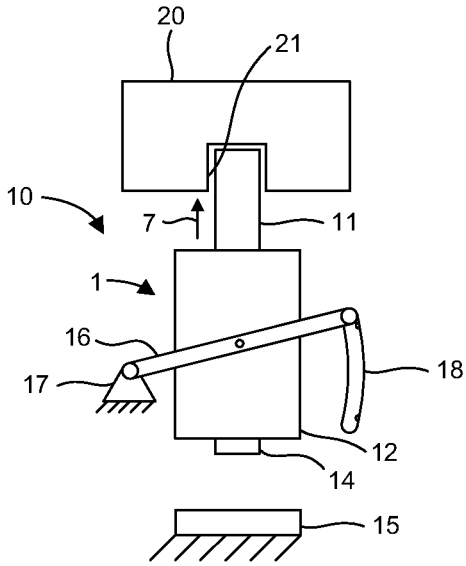
FIG. 1C is the bomb rack lock of FIG. 1A in a locked configuration.

One embodiment of a bomb rack lock 10 is illustrated in FIGS. 1A-1C. In particular, the configuration illustrated in FIG. 1A can be useful for ground operations of the bomb rack when no power is available to electrically unlock or lock a bomb rack linkage 20 of the bomb rack. The configurations illustrated in FIGS. 1B and 1C can be useful for in-flight operations to unlock the bomb rack linkage 20 and deploy a store of bombs. In one aspect, the bomb rack lock 10 can comprise a plunger 11 and a solenoid body 12. The solenoid body 12 can be coupled to and operable to support the plunger 11. With particular reference to FIGS. 1B and 1C, the plunger 11 can be movable to engage the bomb rack linkage 20 to be alternately secured and released. For example, the bomb rack linkage 20 can move generally in direction 3 and can include a catch 21, such as a hole, channel, groove, hook, tab, etc. to interface with the plunger 11 in order to secure and release the bomb rack linkage 20 and prevent movement of the bomb rack linkage 20 in direction 3.

To provide for both in-flight and ground operation of the bomb rack lock 10, the plunger 11 and the solenoid body 12 can be movable relative to each other and the bomb rack linkage 20. To engage and disengage the bomb rack linkage 20, the plunger 11 can be movable generally in direction 4. Additionally, the solenoid body 12 can be movable generally in direction 5. For example, as shown in FIGS. 1A and 1B, the solenoid body 12 can be movable between a first position 1 and a second position 2. In general, the first position 1 is any position of the solenoid body 12 where the plunger 11 is capable of moving to engage the bomb rack linkage 20 and the second position 2 is any position of the solenoid body 12 where the plunger 11 is prevented from moving to engage the bomb rack linkage 20.

With the solenoid body 12 in the first position 1, the plunger 11 can be movable to engage and disengage the bomb rack linkage 20, as shown in FIGS. 1B and 1C. On the other hand, with the solenoid body 12 in the second position 2, as shown in FIG. 1A, engagement between the plunger 11 and the bomb rack linkage 20 can be prevented as the plunger 11 is configured to only move within a limited range. The second position can therefore be configured to position the solenoid body 12 far enough from the bomb rack linkage 20, such that full movement of the plunger 11 through its range of motion is insufficient to allow the plunger 11 to engage or secure the bomb rack linkage 20. Movement of the plunger 11 and the solenoid body 12 can therefore be coordinated in order to secure and release the bomb rack linkage 20. For example, with the solenoid body 12 in position 1 and the plunger extended to engage and secure the bomb rack linkage 20, the bomb rack linkage 20 can be released by moving only the plunger 11, only the solenoid body 12, or by moving both the plunger 11 and the solenoid body 12 in some combination.

In one aspect, the solenoid body 12 can be coupled to a lever arm 16 configured to facilitate movement of the solenoid body 12 between the first position 1 and the second position 2, such as for ground operation of the bomb rack lock 10. The lever arm 16 can be rotatably coupled to a base 17 and can be machine or manually actuatable to move the solenoid body 12 between the first position 1 and the second position 2. In a particular aspect, the lever arm 16 can interface with a channel 18. The channel 18 can include a retaining feature, such as a detent 19*a*, 19*b* or a lock, to inhibit movement of the lever arm 16 from the first position 1 and/or the second position 2. In other words, the solenoid body 12 can be prevented from unintentionally moving out of the first position 1 and/or the second position 2 by use of the retaining feature, thereby preventing unintentionally releasing or securing of the bomb rack linkage 20 through movement of the solenoid body 12.

In another aspect, the bomb rack lock 10 can be configured to automatically lock the bomb rack linkage 20 for in-flight operation in the event that the solenoid body 12 is out of the first position 1 when aircraft power is first applied to the bomb rack in its normal operating sequence. For example, following ground operations of the bomb rack lock 10, the solenoid body 12 may be left out of the first position 1 by mistake or oversight, thus preventing the plunger from engaging the bomb rack linkage 20. To provide for this automatic in-flight locking feature, the bomb rack lock 10 can include a plunger extension 14 configured to apply a force to the solenoid body 12 to move the solenoid body 12 to the first position 1. For example, the bomb rack lock 10 can include or otherwise be associated with a stationary push plate 15 that supports the plunger extension 14 as the plunger extension 14 applies force to the solenoid body 12 to move the solenoid body 12 to the first position 1. Upon movement of the solenoid body 12 to the first position 1, as shown in FIG. 1B, the plunger extension can be retracted from the push plate 15, as shown in FIG. 1C. In a particular aspect, the plunger extension 14 can comprise an extension of the plunger 11 (i.e., in one aspect the plunger extension 14 and the plunger 11 can comprise a single structure; in another aspect the plunger extension 14 can comprise a separate piece coupled to the plunger 11). In this configuration, the plunger 11 can extend from one end of the solenoid body 12 and the plunger extension 14 can extend from an opposite end of the solenoid body 12. Although the plunger extension 14 is shown in the figures as being coupled to or otherwise operable with the solenoid body 12 and separable from the stationary push plate 15, in one alternative, a plunger extension can be coupled to a stationary base and can be separable from the solenoid body 12 (and the plunger 11). In another alternative, a plunger extension can be coupled to both the solenoid body 12 and a stationary base to provide bidirectional movement of the solenoid body 12 between the first position 1 and the second position 2. The plunger 11 and/or the plunger extension 14 can be actuated mechanically, electrically, hydraulically, pneumatically, or in any other suitable manner, alone or in any combination.

In a particular aspect, the plunger 11 can be biased to engage the bomb rack linkage 20, such that actuation of the plunger 11 causes the plunger 11 to disengage the bomb rack linkage 20 and deactivation allows the plunger 11 to move, via its bias, into engagement with the bomb rack linkage 20. For example, the plunger 11 and the plunger extension 14 can comprise a single unitary structure disposed within an electrical coil to form a solenoid. The entire unitary structure can be biased to engage the plunger 11 portion with the bomb rack linkage 20. The solenoid can be actuated to act against the bias and disengage the plunger portion 11 from the bomb rack linkage 20. Simultaneously, the plunger extension portion 14 of the unitary structure can extend from an end of the solenoid body 12. If the plunger extension portion 14 contacts the push plate 15, the plunger extension portion 14 can cause the solenoid body 12 to move toward the first position 1.

Figure 2A:
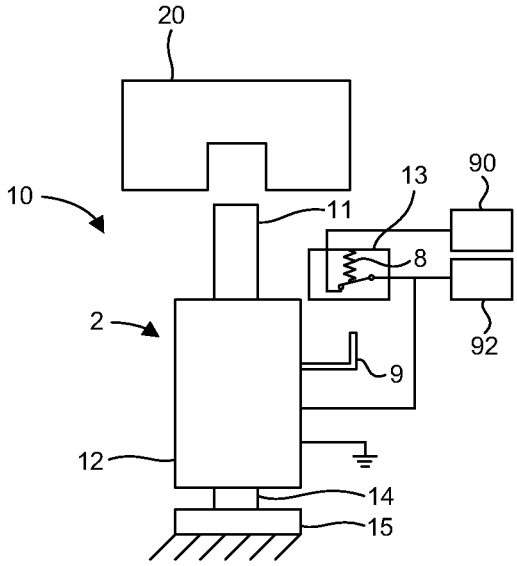
FIG. 2A is an example schematic illustration of switch of a bomb rack lock in a closed configuration, in accordance with an exemplary embodiment of the present invention.
Figure 2B:
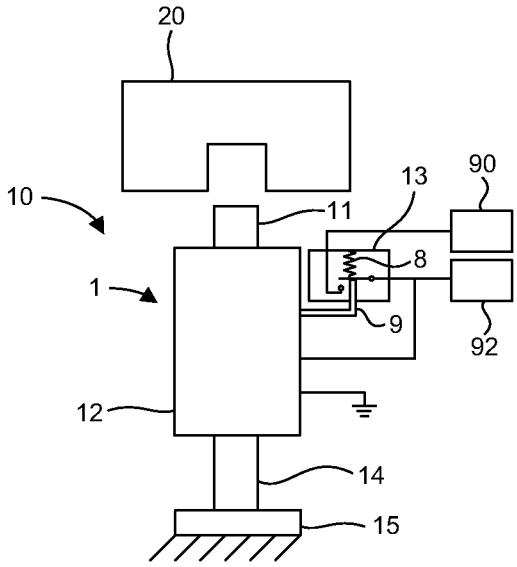
FIG. 2B is an example schematic illustration of the switch of FIG. 2A in an open configuration.

The bomb rack lock 10 can also include a sensor to determine whether the solenoid body 12 is in the first position 1 (or the second position 2). For example, to automatically lock the bomb rack linkage 20, upon the sensor determining that the solenoid body 12 is not in the first position 1, the plunger extension 14 can cause the solenoid body 12 to move to the first position 1. In a particular exemplary embodiment illustrated schematically in FIGS. 2A and 2B and with continued reference to FIGS. 1A-1C, the sensor can comprise a switch 13 that is open when the solenoid body 12 is at the first position 1. In other words, as illustrated in FIG. 2A with the solenoid body 12 at the second position 2, when the solenoid body 12 is out of the first position 1, the switch 13 is closed. The switch 13 can be maintained closed by a spring 8. The solenoid body 12 can include a member 9 configured to open the switch 13 when the solenoid body 12 is at the first position 1. The switch remains closed until the solenoid body 12 is at the first position 1, as shown in FIG. 2B. For example, when the solenoid body 12 is at the first position 1, the member 9 can cause the switch 13 to open and push against the spring 8, which is biased to maintain the switch 13 closed. When the solenoid body 12 is out of the first position 1, the member 9 does not prevent the spring 8 from biasing the switch 13 closed.

In a particular aspect, the detent 19*a* can assist the solenoid body 12 in moving to, and maintaining the first position 1. For example, as the solenoid body 12 moves toward the first position 1, the lever arm 16 interfaces with the channel 18 until the lever arm encounters the detent 19*a*. Initially, the detent 19*a* can resist movement of the lever arm 16, but as the lever arm 16 continues along the channel 18 past the detent 19*a*, the detent 19*a* can urge the lever arm 16 forward in the direction of travel, forcing the solenoid body 12 into the first position 1. Thus, the detent 19*a* can help ensure that the member 9 is able to open the switch 13 by providing a force to act against the spring 8 that biases the switch in the closed position.

In one aspect, the switch 13 can be electrically coupled to a power supply 90, such that when power is supplied to the switch 13 and the solenoid body 12 is not in the first position 1, power can be supplied to a solenoid or motor via the switch 13 to actuate the plunger extension 14 and cause the solenoid body 12 to move to the first position 1. In this way, the solenoid body 12 can be automatically moved to the first position 1 to lock the bomb rack linkage 20 upon powering up the power supply. Alternatively, when the solenoid body 12 is in the first position 1 and the switch 13 is open, the solenoid or motor can receive an actuation signal or power from a command module 92, such as for in-flight operation of the bomb rack lock 10. In this way, the plunger 11 can be actuated to disengage from the bomb rack linkage 20 as described herein. In one aspect, the command module 92 can receive power from the power supply 90 in order to actuate the plunger 11.

As used herein, the term "sensor" is not to be limited to traditional sensors only, and may include a device that can be used to function as a sensor, such as a switch. A sensor can include a position sensor, a Hall effect sensor, a capacitive sensor, a laser rangefinder, a linear encoder, a rotary encoder, a switch, or any other type of sensor or device that can be used to determine the position of the solenoid body 12.

It should be recognized that a solenoid body as disclosed herein need not be oriented such that the plunger moves perpendicular to the bomb rack movement. For example, a solenoid body can be disposed such that the plunger moves parallel to the bomb rack movement, such as to actuate a lever that engages/disengages the bomb rack or to operate a crank that causes engagement/disengagement with the bomb rack.

In use, such as for ground operation, FIG. 1A depicts the bomb rack lock 10 with the solenoid body 12 in the second position 2, where the plunger 11 is prevented from engaging the bomb rack linkage 20. The solenoid body 12 may have been moved to the second position 2 by a user moving the lever arm 16 until the plunger 11 had disengaged the bomb rack linkage 20. To secure the bomb rack linkage 20, the solenoid body 12 can be moved to the first position 1 using the lever arm 16 to engage the bomb rack linkage 20 with the plunger 11. Alternatively, to automatically lock the bomb rack linkage 20 when the aircraft is powered up, as shown in FIG. 1B, the plunger extension 14 can be actuated to apply a force to the push plate 15 to move the solenoid body 12 in direction 6 to the first position 1. Actuation of the plunger extension 14 can be initiated using a sensor, such as switch 13, as discussed above. Upon the solenoid body 12 reaching the first position 1, the switch 13 can open to disconnect the power supply. Furthermore, as shown in FIG. 1C, the plunger 11 can engage the bomb rack linkage 20 when the solenoid body 12 is in the first position 1. With a biased plunger 11, loss of power or deactivation can allow the plunger 11 to bias in direction 7 into engagement with the bomb rack linkage 20. Alternatively, for in-flight operation, the plunger 11 can be actuated to engage the bomb rack linkage 20. With the solenoid body 12 in the first position 1, the plunger 11 can be actuated to disengage from the bomb rack linkage 20. The solenoid body 12 can also be moved from the second position 2 to the first position 1 in order to disengage the plunger 11 from the bomb rack linkage 20.

In one embodiment, the bomb rack linkage 20 can include a linkage mechanism that interfaces with the bomb rack lock 10 in order to release a bomb prior to discharging the bomb from the bomb rack. A member of a ground crew can manually unlock the rack by moving the lever arm 16 and displacing the solenoid body 12. In this case the manual unlock function is advantageous because it does not require power from the aircraft in order to release the lock. The ground crew member can also manually lock the rack prior to flight. If the bomb rack inadvertently remains unlocked following ground maintenance, the bomb rack lock 10 can be configured to automatically lock the rack to remedy such an oversight. For example, when the aircraft is powered up, the switch 13 can be in the closed position, with the solenoid body 12 out of the first position 1, to cause power to be supplied to a solenoid to cause the plunger extension 14 to push against the push plate 15 until the solenoid body 12 is displaced to the first position 1. At this point, the switch 13 can open to deactivate the solenoid. Upon deactivation of the solenoid, the plunger 11 can be biased to move into engagement with the bomb rack linkage 20, thus automatically locking the bomb rack when the aircraft is powered up. In the locked position, an in-flight crew member can unlock the bomb rack by sending a signal to move the plunger 11 out of engagement with the bomb rack linkage 20. For example, the signal can provide power to activate the solenoid, thereby causing the plunger 11 to move against the bias and out of engagement with the bomb rack linkage 20. With the bomb rack linkage 20 unlocked, the linkage can be moved to release the bomb so that the bomb can be ejected from the rack as intended.

Figure 3A:
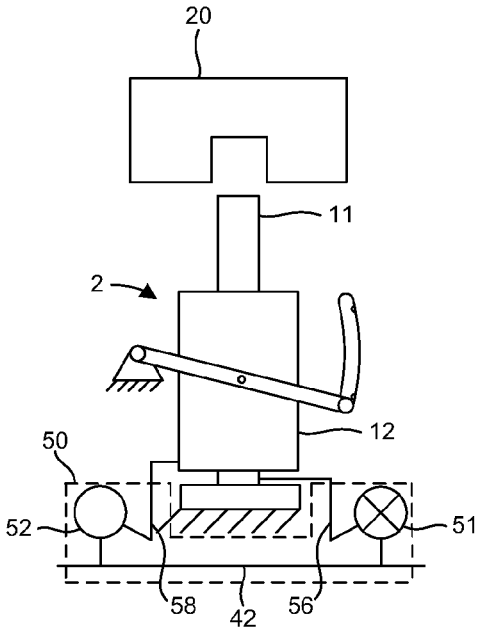
FIG. 3A is an example illustration of redundancy system of a bomb rack lock, in accordance with an exemplary embodiment of the present invention in a ground configuration.
Figure 3B:
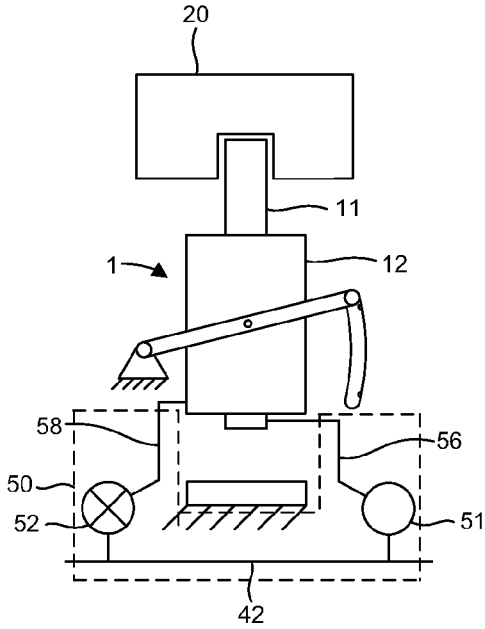
FIG. 3B is the redundancy system of FIG. 3A in a locked configuration.
Figure 3C:
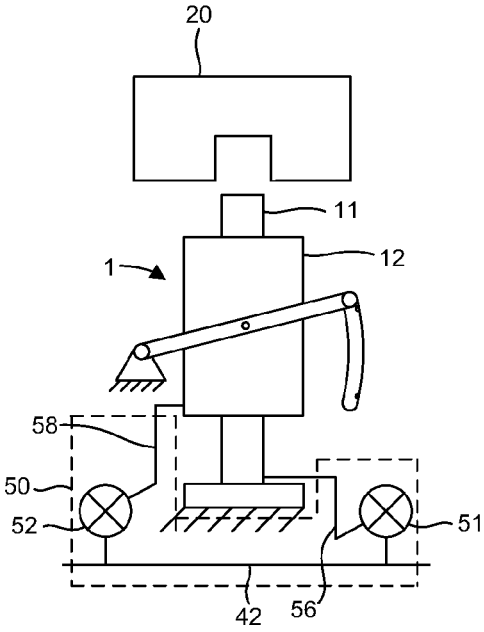
FIG. 3C is the redundancy system of FIG. 3A in an armed configuration.
Figure 4:
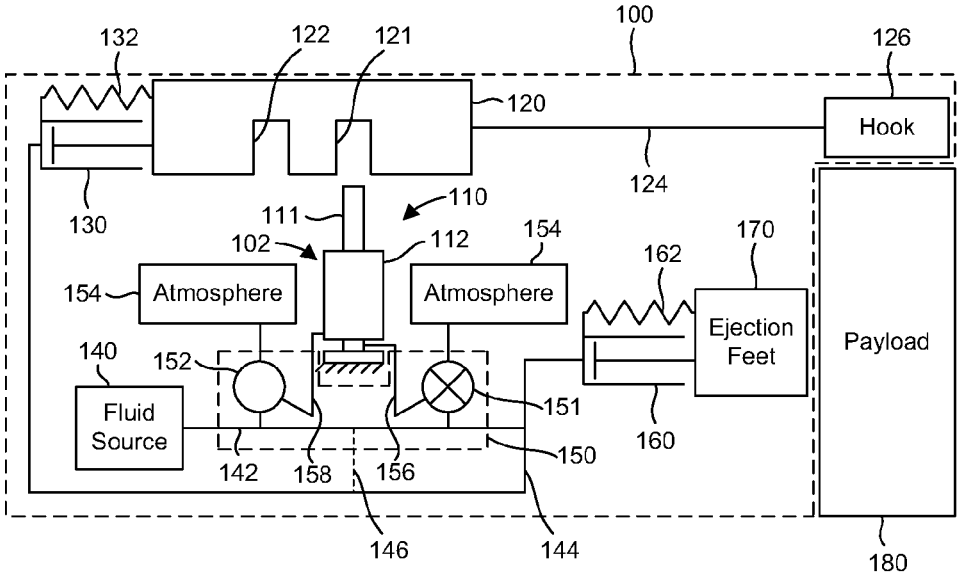
FIG. 4 is a schematic illustration of a bomb rack lock system in a first configuration, in accordance with an exemplary embodiment of the present invention.

As illustrated in FIGS. 3A-3C, a redundancy system 50 can be used to prevent unwanted movement of the bomb rack linkage 20. In general, the redundancy system 50 can include vents 51, 52 to ensure that the bomb rack linkage 20 cannot be actuated for movement to discharge the store of bombs unless the solenoid body 12 is in the first position 1 and the plunger 11 is not engaged with the bomb rack linkage 20. The vent 51 can have an open position (shown in FIG. 3B) and a closed position (shown in FIGS. 3A and 3C). The vent 51 can be configured to vent to atmosphere or some other low pressure sink to allow pressurized fluid to escape fluid conduit 42. The redundancy system 50 can also have a coupling 56 between the plunger 11 and the vent 51. For ease of illustration, the coupling 56 is shown attached to an extension (e.g., a plunger extension) of the plunger 11 that extends from an opposite end of the solenoid body 12 and the bomb rack linkage 20 interfacing end of the plunger 11. Such an extension may be a plunger extension 14 coupled to a plunger 11, as discussed above with reference to FIGS. 1A-1C. The coupling 56 can be configured to activate and open the vent 51 when the plunger 11 is engaged with the bomb rack linkage 20 and to deactivate and close the vent 51 when the plunger 11 is disengaged from the bomb rack linkage 20. The coupling 56 can comprise mechanical, electrical, hydraulic, pneumatic, or other suitable components, alone or in any combination. For example, the coupling 56 can include a mechanical linkage, which is not dependent on electrical power to operate the vent 51.

When open, the vent 51 can cause pressurized fluid to escape the fluid conduit 42 to prevent actuation of the bomb rack linkage 20. When closed, the vent 51 can prevent pressurized fluid from escaping the fluid conduit 42 via the vent to pressurize and facilitate movement of the bomb rack linkage 20. Thus, the vent can be controlled by the plunger 11 to prevent actuation the bomb rack linkage 20. This configuration can prevent over-pressurizing the fluid system when movement of the bomb rack linkage 20 would be prevented by the plunger 11.

The redundancy system 50 can further include a second vent 52. Like the first vent 51, the second vent 52 can have an open position (shown in FIG. 3A) and a closed position (shown in FIGS. 3B and 3C). Also like the first vent 51, the second vent 52 can be configured to vent to atmosphere or some other low pressure sink to allow pressurized fluid to escape the fluid conduit 42.

The redundancy system 150 can also have a second coupling 58 between the solenoid body 12 and the second vent 52. The solenoid body 12 can be movable relative to the bomb rack linkage 20 between the first position 1 (shown in FIGS. 3B and 3C) and the second position 2 (shown in FIG. 3A). With the solenoid body 12 in the first position 1, the plunger 11 can be movable to engage and disengage the bomb rack linkage 20. With the solenoid body 12 in the second position 2, the plunger 11 is prevented from engaging the bomb rack linkage 20. The second coupling 58 can be configured to activate and open the second vent 52 when the solenoid body 12 is out of the first position 1, and to deactivate and close the second vent 52 when the solenoid body 12 is in the first position 1. When open, the second vent 52 can cause pressurized fluid to escape the fluid conduit 42 to prevent actuation of the bomb rack linkage 20. When closed, the second vent 52 can prevent pressurized fluid from escaping the fluid conduit 42 via the second vent 52. Thus, the second vent 52 can be controlled by the solenoid body 12 to prevent actuation of the bomb rack linkage 20 when the solenoid body 12 is in a position where the plunger 11 cannot prevent movement of the bomb rack linkage 20. This configuration can provide a safety feature when movement of the bomb rack linkage 20 is unwanted, such as in situations where movement could be dangerous. Using two vents 51, 52 can allow a configuration where movement of the bomb rack linkage 20 is only possible when the solenoid body 12 and the plunger 11 are in specific, desirable positions to prevent structural damage and improve safety. For example, the pressurized fluid can cause the bomb rack linkage 20 to move only when the first vent 51 and the second vent 52 are each in the closed position.

It should be recognized that a vent can be digital in nature, being only either fully open or fully closed. On the other hand, a vent can be analog in nature, with a transition between fully open and fully closed. As such, an "open" vent can be less than fully open and a "closed" vent can be less than fully closed. An "open" analog vent can therefore result in some fluid pressure acting on a piston, which can cause some negligible amount of movement of a bomb rack. This is within the scope of the present disclosure and is acceptable for an "open" vent, since a negligible amount of movement of the bomb rack is not likely to pose a safety concern and over-pressurization of the fluid system is not likely, given the open vent, even if not fully open.

In one embodiment, the valves 51, 52 can be substituted with electrical switches and the fluid conduit 42 can be substituted with a control circuit. Thus, the positions of the solenoid body 12 and the plunger 11 can be used to control switches coupled to a control circuit that allows or prevents actuation of the bomb rack linkage 20. For example, the control circuit can control firing of a cartridge that generates a gas propellant for actuating the bomb rack linkage 20. Such control circuits and cartridges are commonly found in traditional bomb rack actuation designs.

Shown in FIGS. 4-11 are schematic illustrations of a bomb rack lock system 100. The system 100 can include a movable bomb rack linkage 120 and a bomb rack lock 110 operable with the bomb rack linkage 120 to alternately secure and release the bomb rack linkage 120. The bomb rack linkage 120 and the bomb rack lock 110 can be similar in many respects to the bomb rack linkage 20 and the bomb rack lock 10 discussed above with regard to FIGS. 1A-1C. For example, the bomb rack lock 110 can include a solenoid body 112 and a plunger 111 coupled to or otherwise operable with the solenoid body 112. The plunger 111 can be movable relative to the solenoid body 112 to engage and disengage the bomb rack linkage 120. The system 100 can further include a piston 130 in fluid communication with a fluid source 140 via a fluid conduit 142. The fluid source 140 can be configured to provide a pressurized fluid to actuate the piston 130 to apply a force to the bomb rack linkage 120 to cause the bomb rack linkage 120 to move or displace. In one aspect, the fluid source 140 can comprise a pyrotechnic charge configured to generate pressurized gas. In another aspect, the fluid source 140 can comprise a reservoir of pressurized fluid, controlled by various valving and control systems.

The system 100 can further comprise a redundancy system 150 to prevent unwanted movement of the bomb rack linkage 120. The redundancy system 150 can have a vent 151 in fluid communication with the fluid source 140. The vent 151 can have an open position (shown in FIGS. 5, 8, and 11) and a closed position (shown in FIGS. 4, 6, 7, 9, and 10). The vent 151 can be configured to vent to atmosphere 154 or some other low pressure sink to allow pressurized fluid to escape the fluid conduit 142. The redundancy system 150 can also have a coupling 156 between the plunger 111 and the vent 151. For ease of illustration, the coupling 156 is shown attached to an extension (e.g., a plunger extension) of the plunger 111 that extends from an opposite end of the solenoid body 112 and the bomb rack linkage 120 interfacing end of the plunger 111. Such an extension may be a plunger extension 14 coupled to a plunger 11, as discussed above with reference to FIGS. 1A-1C. The coupling 156 can be configured to activate and open the vent 151 when the plunger 111 is engaged with the bomb rack linkage 120 and to deactivate and close the vent 151 when the plunger 111 is disengaged from the bomb rack linkage 120. The coupling 156 can comprise mechanical, electrical, hydraulic, pneumatic, or other suitable components, alone or in any combination. For example, the coupling 156 can include a mechanical linkage, which is not dependent on electrical power to operate the vent 151.

When open, the vent 151 can cause the pressurized fluid to escape the fluid conduit 142 to prevent actuation of the piston 130 and movement of the bomb rack linkage 120. When closed, the vent 151 can prevent pressurized fluid from escaping the fluid conduit 142 via the vent to pressurize and actuate the piston 130, and to facilitate movement of the bomb rack linkage 120. Thus, the vent 151 can be controlled by the plunger 111 to prevent actuation of the piston 130 when the plunger 111 is engaged with the bomb rack linkage 120. This configuration can prevent over-pressurizing the fluid system when movement of the piston 130 would be prevented by the plunger 111.

The redundancy system 150 can further include a second vent 152 in fluid communication with the fluid source 140. Like the first vent 151, the second vent 152 can have an open position (shown in FIG. 4) and a closed position (shown in FIGS. 5-11). Also like the first vent 151, the second vent 152 can be configured to vent to atmosphere 154 or some other low pressure sink to allow pressurized fluid to escape the fluid conduit 142. In one aspect, both vents 151, 152 can be "upstream" of a fluid path 144 to the piston 130. In another aspect, one vent, such as vent 152, can be "upstream" of a fluid path 146 to the piston 130 and another vent, such as vent 151, can be "downstream" of the fluid path 146. It should also be recognized that both vents 151, 152 can be "downstream" of a fluid path to piston 130. The relationship of fluid paths and vents need only be such that the vents can properly vent the fluid conduit 142 to depressurize the fluid system and minimize or prevent movement of the piston 130.

The redundancy system 150 can also have a second coupling 158 between the solenoid body 112 and the second vent 152. The solenoid body 112 can be movable relative to the bomb rack linkage 120 between a first position (shown in FIGS. 5-11) and a second position (shown in FIG. 4). With the solenoid body 112 in the first position 101, the plunger 111 can be movable to engage and disengage the bomb rack linkage 120. With the solenoid body 112 in the second position 102, the plunger 111 is prevented from engaging the bomb rack linkage 120. The second coupling 158 can be configured to activate and open the second vent 152 when the solenoid body 112 is out of the first position 101, and to deactivate and close the second vent 152 when the solenoid body 112 is in the first position 101. When open, the second vent 152 can cause pressurized fluid to escape the fluid conduit 142 to prevent actuation of the piston 130 and movement of the bomb rack linkage 120. When closed, the second vent 152 can prevent pressurized fluid from escaping the fluid conduit 142 via the second vent 152. Thus, the second vent 152 can be controlled by the solenoid body 112 to prevent actuation of the piston 130 when the solenoid body 112 is in a position where the plunger 111 cannot prevent movement of the bomb rack linkage 120. This configuration can provide a safety feature when movement of the bomb rack linkage 120 is unwanted, such as in situations where movement could be dangerous. Using two vents 151, 152 can allow a configuration where movement of the bomb rack linkage 120 is only possible when the solenoid body 112 and the plunger 111 are in specific, desirable positions to prevent structural damage and improve safety. For example, the pressurized fluid can actuate the piston 130 and cause the bomb rack linkage 120 to move only when the first vent 151 and the second vent 152 are each in the closed position.

It should be recognized that a vent can be digital in nature, being only either fully open or fully closed. On the other hand, a vent can be analog in nature, with a transition between fully open and fully closed. As such, an "open" vent can be less than fully open and a "closed" vent can be less than fully closed. An "open" analog vent can therefore result in some fluid pressure acting on a piston, which can cause some negligible amount of movement of a bomb rack. This is within the scope of the present disclosure and is acceptable for an "open" vent, since a negligible amount of movement of the bomb rack is not likely to pose a safety concern and over-pressurization of the fluid system is not likely, given the open vent, even if not fully open.

The bomb rack linkage 120 can include a first catch 121 and a second catch 122. Each of the first catch 121 and the second catch 122 can be engageable and disengageable with the plunger 111 to alternately secure and release the bomb rack linkage 120. In one aspect, the plunger 111 can engage the first catch 121 to secure the bomb rack linkage 120 in a first position and the plunger 111 can engage the second catch 122 to secure the bomb rack linkage 120 in a second position. For example, the second catch 122 can be engaged by the plunger 111 following release of the plunger 111 from the first catch 121 and movement of the bomb rack linkage 120. In a particular aspect, the engagement with the second catch 122 can be used to control the first vent 151. For example, the engagement with the second catch 122 can cause the coupling 156 to open the vent 151 to cause the pressurized fluid to escape the fluid conduit 142 to prevent further movement of the bomb rack linkage 120 by the piston 130. Thus, the second catch 122 can provide the dual functions of securing the bomb rack linkage 120 in a given position and controlling the vent 151. In one aspect, a spring 132 can be included that provides a force on the bomb rack linkage 120. In a particular aspect, the spring 132 can act against movement of the bomb rack linkage 120 from an engagement position with the first catch 121 to an engagement position with the second catch 122. Thus, for example, the spring 132 can apply a force on the bomb rack linkage 120 to return the bomb rack linkage 120 to engage the first catch 121 upon release from the second catch 122.

The bomb rack lock system 100 can further comprise a second piston 160 in fluid communication with the fluid source 140 via the fluid conduit 142. As with the first piston 130, the fluid source 140 can be configured to provide pressurized fluid to actuate the second piston 160. The second piston 160 can be configured to apply a force to ejection feet 170 to cause the ejection feet 170 to move. In this case, engagement of the plunger 111 with the second catch 122 can cause the coupling 156 to open the vent 151 and the pressurized fluid to escape the fluid conduit 142 to prevent further movement of the ejection feet 170 by the second piston 160. In one aspect, a spring 162 can be included that acts against movement of the ejection feet 170 caused by the second piston 160. Thus, for example, the spring 162 can apply a force on the ejection feet 170 to retract the ejection feet 170 upon venting of the pressurized fluid.

In one aspect, the bomb rack linkage 120 can include a mechanism configured to alternately secure and release a payload 180 upon movement of the bomb rack linkage 120, such as a linkage member. Such movement can be between a first position with the plunger 111 engaging the first catch 121 and a second position with the plunger 111 engaging the second catch 122. The securing and releasing mechanism can include a coupling feature, such as a hook 126 to couple with the payload 180. The hook 126 can be moved to secure or release the payload 180 by a coupling 124, such as a mechanical linkage, with the bomb rack linkage 120. In a particular aspect, the bomb rack linkage 120 can form a part of a mechanical linkage coupled to the hook 126. In another aspect, the ejection feet 170 can be configured to transfer force from the second piston 160 to the payload 180 to discharge the payload 180 from a stored position. Actuation of the second piston 160 can be coordinated with actuation of the hook 126 to apply a force to the payload 180 following release from the hook 126.

Figure 5:
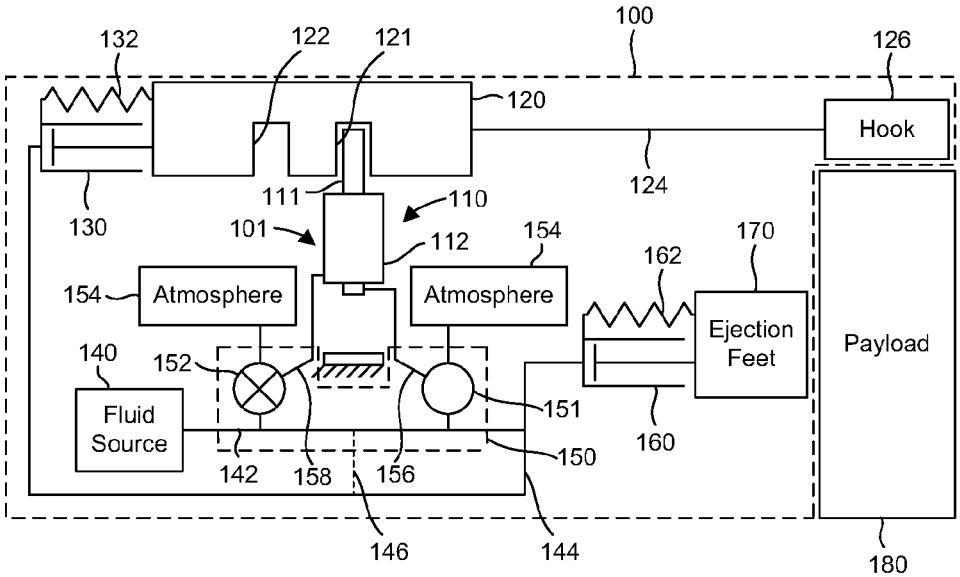
FIG. 5 is a schematic illustration of the bomb rack lock system of FIG. 4 in a second configuration.
Figure 6:
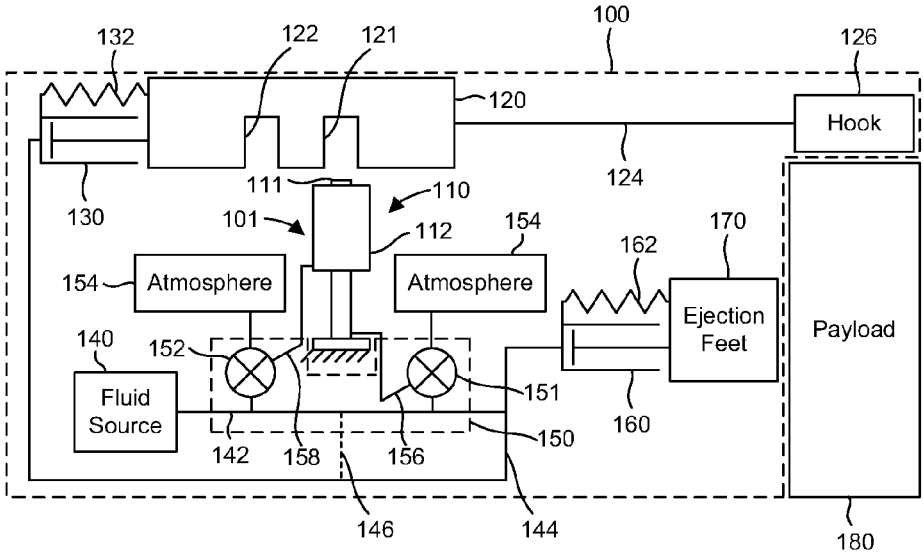
FIG. 6 is a schematic illustration of the bomb rack lock system of FIG. 4 in a third configuration.
Figure 7:
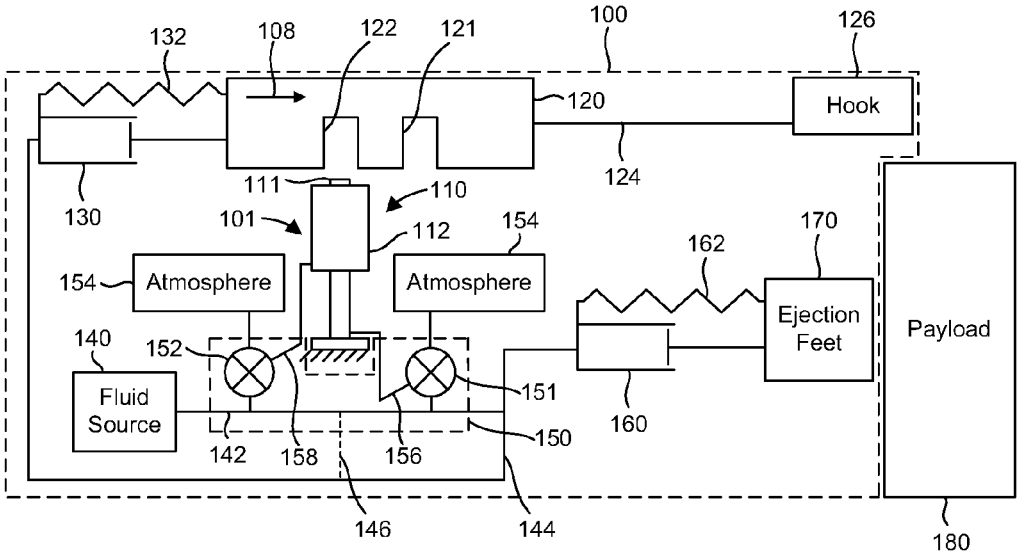
FIG. 7 is a schematic illustration of the bomb rack lock system of FIG. 4 in a fourth configuration.
Figure 8:
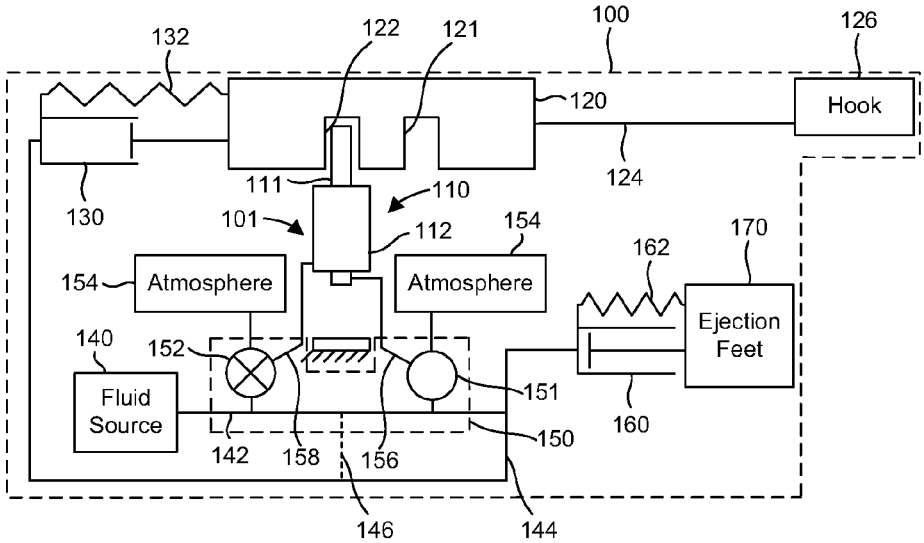
FIG. 8 is a schematic illustration of the bomb rack lock system of FIG. 4 in a fifth configuration.
Figure 9:
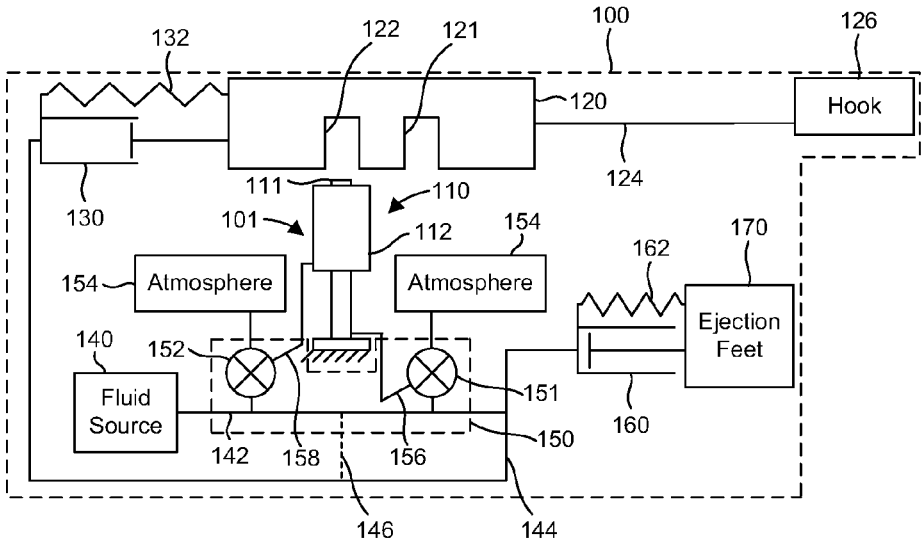
FIG. 9 is a schematic illustration of the bomb rack lock system of FIG. 4 in a sixth configuration.
Figure 10:
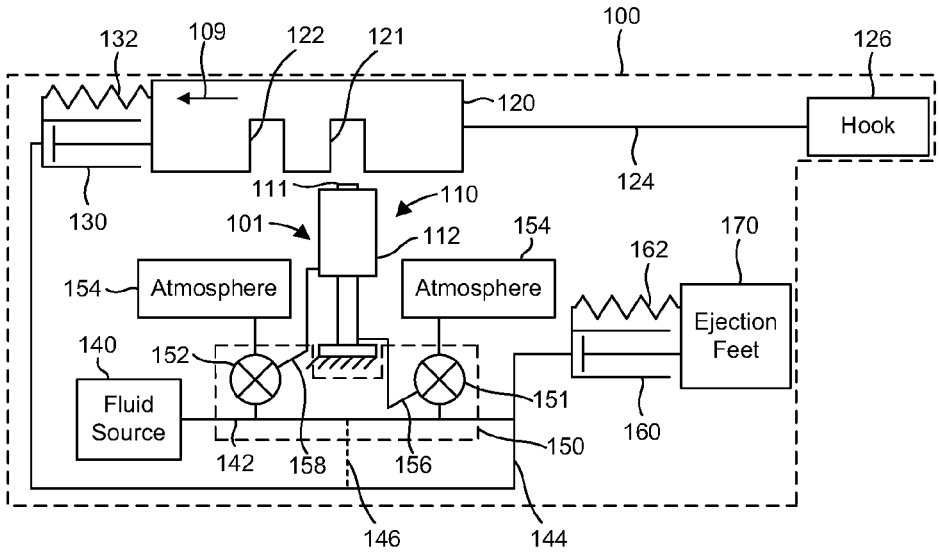
FIG. 10 is a schematic illustration of the bomb rack lock system of FIG. 4 in a seventh configuration.
Figure 11:
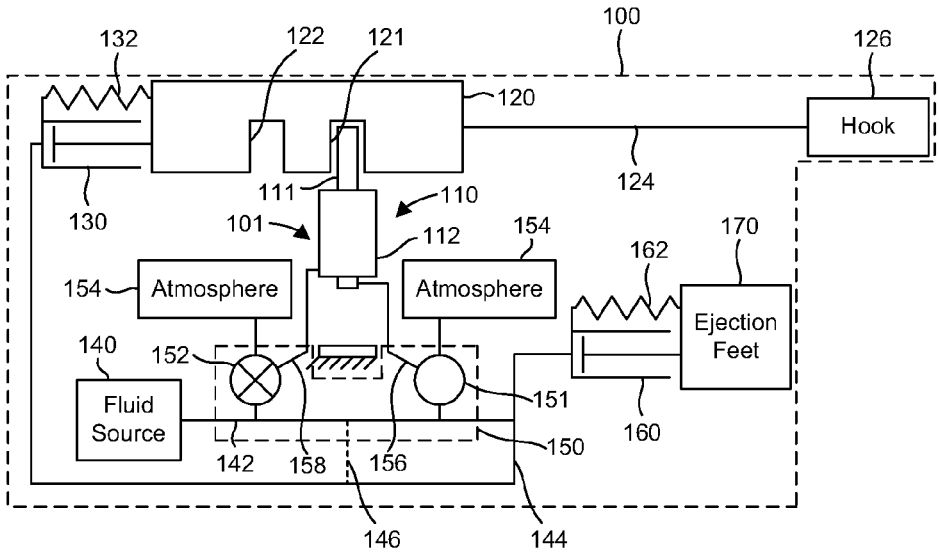
FIG. 11 is a schematic illustration of the bomb rack lock system of FIG. 4 in an eighth configuration.

With continued reference to FIGS. 4-11, in use, the bomb rack lock system 100 can be configured as a bomb rack lock and a bomb ejector from a bomb rack. For example, FIG. 4 can represent a bomb rack lock 110 in a manually unlocked position, as discussed above with reference to FIGS. 1A-1C. In this position, in the event of a discharge of the gas source 140 while on the ground, the valve 152 is open to prevent the bomb rack from unlocking due to release of the hook 126 caused by movement of an actuation linkage member 120. The actuation linkage member 120 can be coupled to or included in an actuation linkage 124. Open valve 152 can provide safety for the ground crew while performing maintenance on the aircraft. FIG. 5 can represent the bomb rack in a locked configuration prior to discharge of a bomb 180. In this position, the vent 151 is open to prevent damage to the system in the event of a discharge of the gas source 140 prior to disengagement of the plunger 111 from the linkage 120. As represented in FIG. 6, upon activation of the plunger 111 to disengage from the linkage member 120, both the vent 151 and the vent 152 are closed, which will allow pressurized gas to move piston 130 and piston 160. As represented in FIG. 7, the movement of piston 130 moves the linkage member 120 in direction 108, thereby causing the hook to release the bomb 180. Movement of the piston 160 can be delayed to allow for the release of the bomb 180 from the hook 126 prior to force from ejection feet 170 discharging the bomb 180 from the rack. With the fluid system pressurized, piston 130 and piston 160 are prevented from retracting, despite the influence of the springs 132, 162, respectively, that can be configured to retract the linkage 120 and the ejection feet 170, respectively. Thus, as represented in FIG. 8, the plunger 111 can engage the second catch 122 of the linkage 120. This position of the plunger 111 can allow the vent 151 to open, thereby venting the fluid system and allowing the spring 162 to retract the ejection feet 170. The spring 132, however, is prevented from retracting the linkage 120 due to the engagement between the plunger and the second catch 122. As represented in FIG. 9, the plunger 111 can be disengaged from the second catch 122. With the disengagement of the plunger 111 from the second catch 122, the linkage 120 can be moved in direction 109 by the spring 132 to retract the linkage 120 and the hook 126, as represented in FIG. 10. At this point, the plunger 111 can again be engaged with the linkage 120, as represented in FIG. 11. In accordance with an exemplary embodiment, a method for facilitating locking and release of a bomb rack linkage is disclosed. The method can comprise providing a bomb rack lock, such as a bomb rack lock as described herein, operable with a bomb rack to alternately secure and release the bomb rack linkage, the bomb rack lock having a plunger movable to engage the bomb rack linkage, a solenoid body coupled to and operable to support the plunger, the plunger and the solenoid body being movable relative to each other and the bomb rack linkage, and a sensor to determine whether the solenoid body is in the first position. By providing a bomb rack lock, the method can further comprise facilitating movement of the solenoid body to a first position, wherein the plunger is in a position to can engage the bomb rack linkage. The method can further comprise facilitating movement of the plunger to engage and disengage the bomb rack linkage with the solenoid body in the first position. The method can further comprise facilitating movement of the solenoid body to a second position to prevent engagement between the plunger and the bomb rack linkage. In accordance with another exemplary embodiment, a method for facilitating locking and release of a bomb rack linkage is disclosed. The method can comprise providing a bomb rack linkage selectively movable between at least first and second positions. The method can further comprise providing a piston in fluid communication with a fluid source via a fluid conduit, the fluid source being configured to provide a pressurized fluid to actuate the piston to apply a force to the bomb rack linkage to cause the bomb rack linkage to move. The method can further comprise providing a bomb rack lock, such as a bomb rack lock as described herein, operable with a bomb rack linkage to alternately secure and release the bomb rack. The method can further comprise providing a redundancy system to prevent unwanted movement of the bomb rack linkage, the redundancy system having a vent in fluid communication with the fluid source, the vent having an open position and a closed position. The method can further comprise facilitating opening and closing of the vent, wherein opening of the vent causes the pressurized fluid to escape the fluid conduit to prevent actuation of the piston and movement of the bomb rack linkage, and closing of the vent prevents pressurized fluid from escaping the fluid conduit via the vent to facilitate movement of the bomb rack linkage.

Facilitating opening and closing of the vent can comprise providing a coupling between the plunger of the bomb rack lock and the vent, the coupling being configured to activate and open the vent when the plunger is engaged with the bomb rack linkage, and to deactivate and close the vent when the plunger is disengaged from the bomb rack linkage.

Facilitating opening and closing of the vent can further comprise providing a second vent in fluid communication with the fluid source. The second vent can have an open position and a closed position. A second coupling between the solenoid body and the second vent can be provided, the solenoid body being movable relative to the bomb rack linkage between a first position and a second position. The plunger can be movable to engage and disengage the bomb rack linkage with the solenoid body in the first position, wherein the solenoid body, in the second position, prevents engagement between the plunger and the bomb rack linkage. The second coupling can be configured to activate and open the second vent when the solenoid body is out of the first position, and to deactivate and close the second vent when the solenoid body is in the first position. The second vent, when open, can cause the pressurized fluid to escape the fluid conduit to prevent actuation of the piston and movement of the bomb rack linkage. The second vent, when closed, can prevent pressurized fluid from escaping the fluid conduit via the second vent, wherein the pressurized fluid actuates the piston and causes the bomb rack linkage to move when the first vent and the second vent are each in the closed positions.

One skilled in the art will recognize that the various components and elements of the invention described herein may be used according to their disclosed relative functions in other applications. For example, the structure describing the bomb rack lock can be used to alternately engage and disengage an object other than a bomb rack linkage. Likewise, the automatic locking features and redundancy system can be used in applications other than those described herein relating to a bomb rack. As such, the terms used herein are not to be limited only to bomb rack applications and terminology and may be viewed generically for use in other applications.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A bomb rack lock, comprising:

a plunger movable to engage a bomb rack linkage to be alternately secured and released;

a solenoid body coupled to and operable to support the plunger, the plunger and the solenoid body being movable relative to each other and the bomb rack linkage, and the solenoid body being movable between a first position and a second position; and a sensor to determine whether the solenoid body is in the first position, wherein the plunger is movable to engage and disengage the bomb rack linkage with the solenoid body in the first position, and wherein the solenoid body, in the second position, prevents engagement between the plunger and the bomb rack linkage.

2. The bomb rack lock of claim 1, further comprising a plunger extension adapted to apply a force to the solenoid body to move the solenoid body to the first position, wherein upon the sensor determining that the solenoid body is not in the first position, the plunger extension is caused to apply the force to move the solenoid body to the first position.

3. The bomb rack lock of claim 2, wherein the plunger extension comprises an extension of the plunger.

4. The bomb rack lock of claim 2, wherein the plunger and the plunger extension are actuated electrically, wherein actuation of the plunger extension causes the solenoid body to move to the first position upon determination by the sensor that the solenoid body is not in the first position, wherein deactivation of the plunger causes the plunger to engage the bomb rack linkage when the solenoid body is in the first position, and wherein actuation of the plunger causes the plunger to disengage the bomb rack linkage when the solenoid body is in the first position.

5. The bomb rack lock of claim 1, wherein the plunger is biased to engage the bomb rack linkage.

6. The bomb rack lock of claim 4, wherein the sensor comprises a switch that is open only when the solenoid body is in the first position, the switch being electrically coupled to a power supply to automatically actuate the plunger extension to move the solenoid body to the first position when the solenoid body is out of the first position.

7. The bomb rack lock of claim 2, further comprising a stationary push plate that supports the plunger extension as the plunger extension applies the force to the solenoid body to move the solenoid body to the first position.

8. The bomb rack lock of claim 1, wherein the solenoid body is coupled to a lever arm that is rotatably coupled to a base, the lever arm being manually actuatable to move the solenoid body between the first position and the second position.

9. A method of facilitating locking and release of a bomb rack, comprising:

providing a bomb rack lock operable with a bomb rack linkage to alternately secure and release the bomb rack linkage, the bomb rack lock having a plunger movable to engage the bomb rack linkage, a solenoid body coupled to and operable to support the plunger, the plunger and the solenoid body being movable relative to each other and the bomb rack linkage, and a sensor to determine whether the solenoid body is in the first position;

facilitating movement of the solenoid body to a first position, wherein the plunger is in a position to can engage the bomb rack linkage;

facilitating movement of the plunger to engage and disengage the bomb rack linkage with the solenoid body in the first position; and facilitating movement of the solenoid body to a second position to prevent engagement between the plunger and the bomb rack linkage.

10. The method of claim 9, wherein facilitating movement of the solenoid body to the first position comprises providing a plunger extension adapted to apply a force to the solenoid body to move the solenoid body to the first position, wherein upon the sensor determining that the solenoid body is not in the first position, the plunger extension is caused to apply the force to move the solenoid body to the first position.

* * * * *